US007273544B2

(12) United States Patent
Hoffmeier

(10) Patent No.: US 7,273,544 B2
(45) Date of Patent: Sep. 25, 2007

(54) SLUDGE EXTRACTOR

(75) Inventor: Dieter Hoffmeier, Ibbenbüren (DE)

(73) Assignee: Oase Wübker GmbH & Co. KG, Hörstel (DE)

( * ) Notice: Subject to any disclaimer, the term of this patent is extended or adjusted under 35 U.S.C. 154(b) by 518 days.

(21) Appl. No.: 10/490,781

(22) PCT Filed: Sep. 25, 2002

(86) PCT No.: PCT/DE02/03643

§ 371 (c)(1),
(2), (4) Date: Sep. 7, 2004

(87) PCT Pub. No.: WO03/031814

PCT Pub. Date: Apr. 17, 2003

(65) Prior Publication Data

US 2005/0000892 A1 Jan. 6, 2005

(30) Foreign Application Priority Data

Sep. 25, 2001 (DE) ..... 101 47 018

(51) Int. Cl.
*B01D 21/22* (2006.01)

(52) U.S. Cl. ..... 210/109; 210/117; 210/416.1

(58) Field of Classification Search ..... 210/923, 210/258, 123, 117, 109, 416.1; 433/92; 417/40, 417/36, 900; 604/319, 320
See application file for complete search history.

(56) References Cited

U.S. PATENT DOCUMENTS 3,138,873 A * 6/1964 Bishop ..... 433/92
5,618,410 A 4/1997 Wallace et al.

FOREIGN PATENT DOCUMENTS

DE 199 42 187 A1 3/2001
FR 2 673 861 A1 9/1992

* cited by examiner

*Primary Examiner*—Terry K. Cecil
(74) *Attorney, Agent, or Firm*—Cohen Pontani Lieberman & Pavane LLP

(57) ABSTRACT

A sludge extractor with a receiving tank, on which a suction connection for a suction element, which draws in a sludge-containing liquid, and a discharge connection for discharge element, which discharges the sludge-containing liquid, are mounted, and with a motor for driving a suction device in such a way that a negative pressure is created in the receiving tank, which negative pressure keeps a vacuum valve on the discharge element closed, is characterized in that the negative pressure acting on the vacuum valve is lower than the pressure which acts on the vacuum valve as a result of the sludge-containing liquid when a predetermined fill level is reached by the sludge-containing liquid in the receiving tank.

9 Claims, 2 Drawing Sheets

SLUDGE EXTRACTOR

PRIORITY CLAIM

This is a U.S. national stage of application No. PCT/DE02/03643, filed on Sep. 25, 2002. Priority is claimed on that application and on the following application(s): Country: Germany, Application No.: 101 47 018.5, Filed: Sep. 25, 2001.

BACKGROUND OF THE INVENTION

1. Field of the Invention

The present invention pertains to a sludge extractor with a receiving tank, on which are mounted a suction connection for a suction element, which draws in a sludge-containing liquid, and a discharge connection for a discharge element, which discharges the sludge-containing liquid, the extractor also being equipped with a motor to drive a suction device in such a way that a negative pressure, which keeps a vacuum valve on the discharge element closed, is created in the receiving tank.

2. Description of the Prior Art

A sludge extractor of this type is known from DE 199 42 187 A1. The suction process is begun by turning on the motor. The receiving tank fills up slowly with sludge-containing liquid until the liquid reaches the level of the vacuum valve. The vacuum valve is closed because of the prevailing negative pressure. When a the liquid reaches a certain limit in the receiving tank, a ball valve closes, as a result of which the motor begins to run audibly faster. This is a sign to the user that it's time to turn off the motor. Turning off the motor has the effect of eliminating the negative pressure in the receiving tank. The internal pressure now being produced by the sludge-containing liquid has the effect of opening the vacuum valve, and the sludge-containing liquid can now escape through the discharge element until the receiving tank is empty again. Then the user can turn the motor on again to repeat the process as often as necessary.

A sludge extractor of this type therefore suffers from the disadvantage that the receiving tank, which fills up relatively quickly, can only be emptied discontinuously, by turning off the motor.

A procedure of this type leads to many interruptions in the suction process itself, and many users find this annoying.

SUMMARY OF THE INVENTION

The task of the present invention is therefore to create a sludge extractor which is able to perform wet-vacuuming continuously.

The task is accomplished according to the invention in that, when the sludge-containing liquid reaches a predetermined level in the receiving tank, the negative pressure acting on the vacuum valve is weaker than the pressure acting on the vacuum valve as a result of the sludge-containing liquid.

The sludge extractor according to the invention offers the advantage that suction can be carried out continuously without the need to turn the unit off repeatedly during the course of the vacuuming process.

BRIEF DESCRIPTION OF THE DRAWINGS

An embodiment of the present invention is described in greater detail below on the basis of the drawings.

DETAILED DESCRIPTION OF THE PREFERRED EMBODIMENTS

Figure 1:
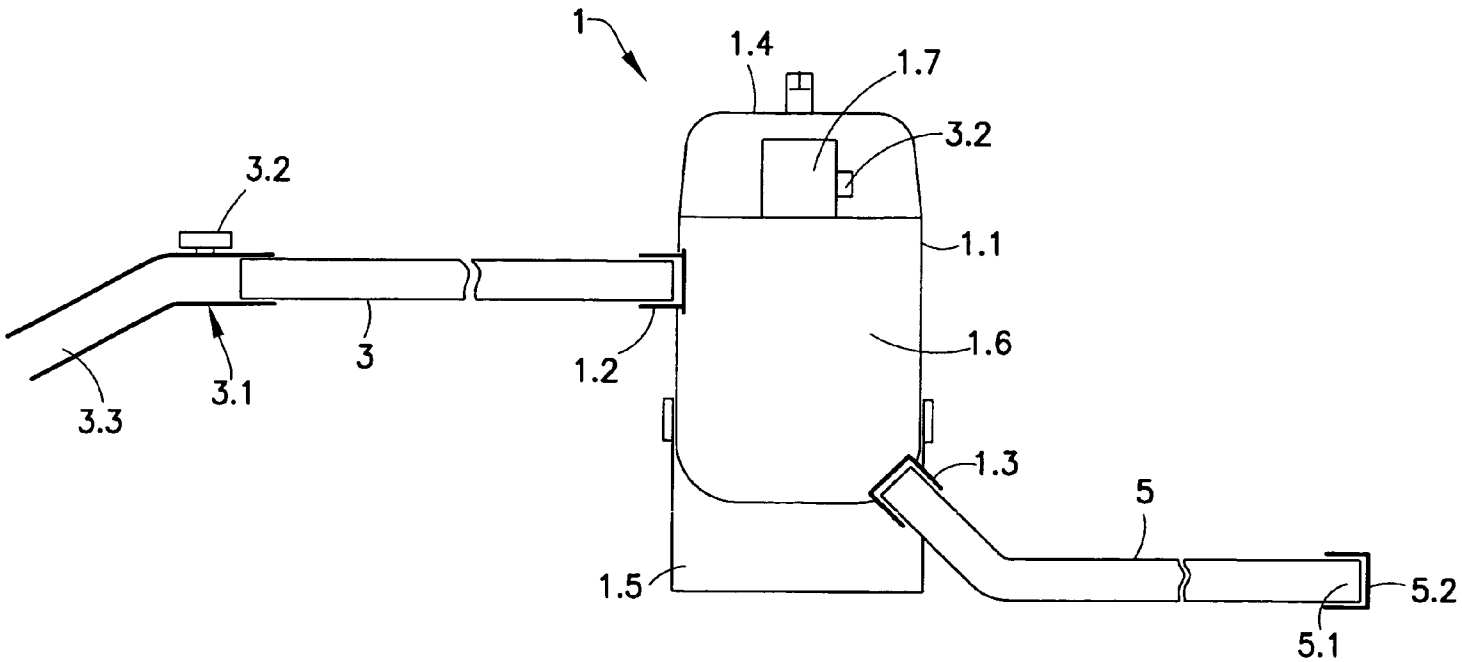
FIG. 1 shows a schematic diagram of a sludge extractor according to the present invention.

An inventive sludge extractor 1 (FIG. 1) comprises a housing 1.1, on which a suction connection 1.2 for a suction element 3 and a discharge connection 1.3 for a discharge element 5 are formed. The housing 1.1 is also designed with a cover 1.4 in its upper area, i.e., the area at the opposite end from the bottom. The cover 1.4 is fastened detachably to the lower housing 1.1. At the bottom, the housing 1.1 is provided with a base element 1.5. The central area of the interior of the housing 1.1 is designed as a receiving tank 1.6 for the sludge-containing liquid, usually a mixture of sludge and water or materials of similar consistency. The suction connection 1.2 is located in the upper part of the receiving tank 1.6, and the discharge connection 1.3 is located in the lower part of the receiving tank 1.6.

Figure 2:
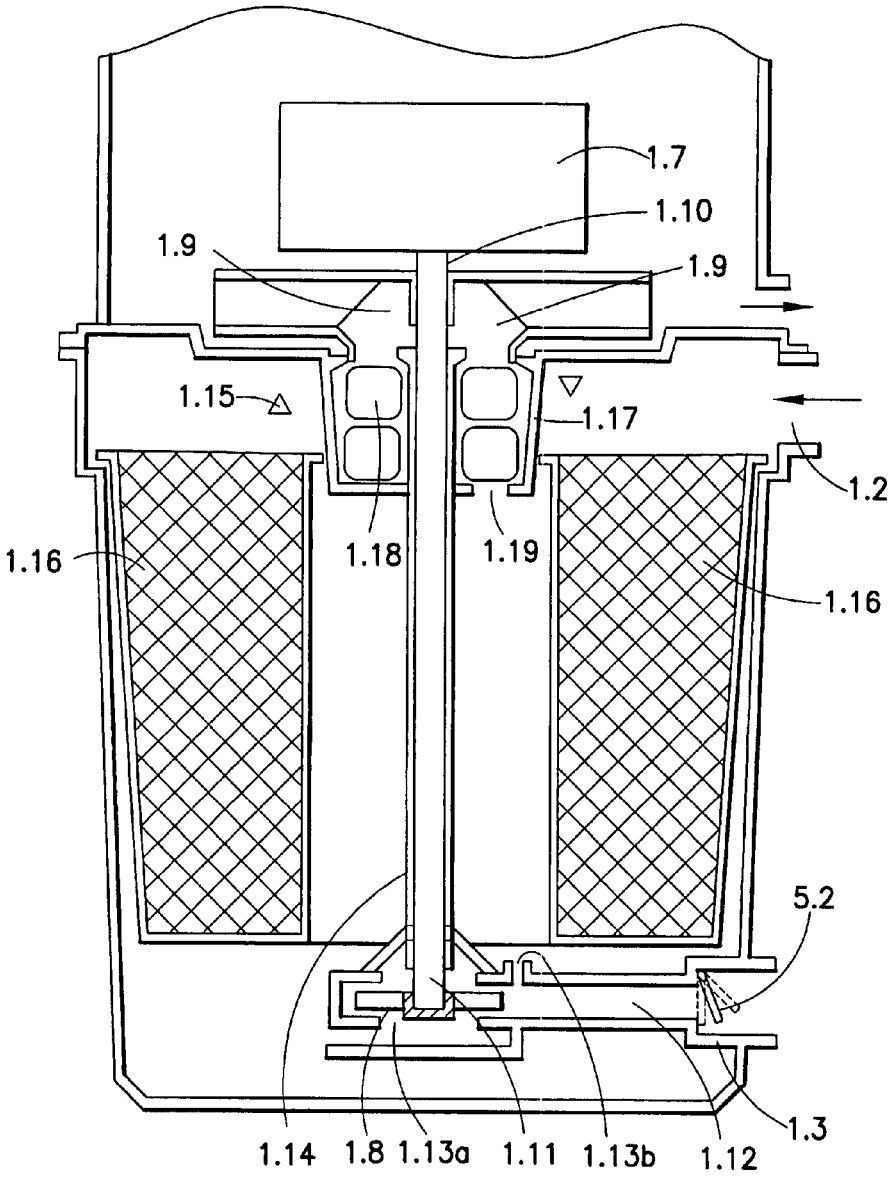
FIG. 2 shows a schematic diagram, in cross section, of the sludge extractor according to the present invention.

Above the receiving tank 1.6, that is, above the area of the housing 1.1 which can be filled with sludge and water, a motor 1.7, preferably an electric motor, is mounted, which drives a generally known suction device 1.8 such as an air-drawing vane element (FIG. 2). While the device is being driven, air is drawn from the receiving tank 1.6 and conveyed to the outside via air outlet openings 1.9 in the upper area of the housing. As a result, a negative pressure is created in the receiving tank 1.6 and in the suction element 3.

The motor 1.7 has a drive shaft 1.10 for the suction device 1.8. The free end 1.11 of this shaft extends to a point near the bottom of the interior of the receiving tank 1.6. The suction device 1.8 or pump is mounted at the free end 1.11 of the drive shaft 1.10. The suction device 1.8 is seated in a flow channel 1.12, which establishes a direct connection to the discharge connection 1.3. In the immediate vicinity (in the present embodiment, below) of the suction device 1.8, a first liquid inlet 1.13*a* is provided, through which the indrawn sludge-containing liquid is admitted. Between the suction device 1.8 and the discharge connection 1.3, a second liquid inlet 1.13*b* is provided in the suction channel 1.12, via which the vacuum valve 5.2 in the discharge connection 1.3 can be decoupled.

The drive shaft 1.10 is supported in a sealed, protective housing 1.14. In the area of the maximum level MAX for water or sludge, a safety valve 1.15 is provided, which closes the air outlets 1.9 when the maximum water level is reached. The safety valve 1.15 is a float valve. In the present embodiment, the drive shaft 1.10 and its protective housing 1.14 are mounted in the center of the receiving tank 1.6. In other embodiments, the drive shaft 1.10 could also be mounted off-center in the receiving tank 1.6.

The safety valve 1.15 is concentric with respect to the drive shaft 1.10. Also concentric with respect to the drive shaft 1.10 and its protective housing 1.14 is a prefilter 1.16. The prefilter 1.16 is installed near the inside wall of the receiving tank 1.6 and serves to keep coarse material such as leaves, small twigs, gravel, etc., away from the suction device 1.8. There is a certain gap between the inside circumference of the prefilter 1.16 and the protective housing 1.14 of the drive shaft 1.10.

The upper suction connection 1.2 is located at the level of the maximum water or fill level. The flow route is limited on the inside by a wall 1.17 of the centrally mounted safety valve 1.15, so that the incoming sludge-containing liquid is diverted downward into the prefilter 1.16 adjacent to the safety valve and then emerges from this filter on all sides or at least radially toward the inside.

The safety valve 1.15 is limited laterally on the outside by the wall 1.17 and on the inside by the protective housing 1.14. In the enclosed space of the safety valve 1.15, a ring-shaped float 1.18 is provided, which, at low water or fill levels, closes off an opening 1.19 at the bottom (the dotted line outline of float 1.18 in the figure shows the position at low water levels). As the water or fill level rises, the sludge-containing liquid rises through the opening 1.19 and lifts the ring-shaped float 1.18 until the ring-shaped float 1.18 closes off the air outlet 1.9 the solid line outline of float 1.18 in the figure shows the position proximate the MAX fill level).

The suction element 3 (FIG. 1) is fastened detachably to the suction connection 1.2 in the generally known manner and is equipped optionally with a radio-control switch 3.2 in a gripping area 3.1. In addition, a suction line 3.3 is formed on the free end of the suction element 3, onto which a suction nozzle (not shown) can be placed. The suction element 3 can be a hose or a pipe.

A discharge element 5 is mounted detachably in the generally known manner on the discharge connection 1.3 and has a vacuum valve 5.2 at its free end 5.1. The discharge element 5 can also be a hose or a pipe. The vacuum valve 5.2 can also be installed in the discharge connection 1.3 or in any other desired position between the discharge connection 1.3 and the free end 5.1.

The device functions as follows.

The suction line 3.3 and optionally the suction nozzle of the suction element 3 hangs down into the water, near the bottom of the pond. The suction process is begun by turning on the motor 1.7, which can be done, for example, by radio control switch 3.2. Via the suction line 3.3, sludge is sucked from the bottom of the pond. The sludge thus passes through the suction element 3 and into the receiving tank 1.6. The receiving tank 1.6 fills up slowly with sludge as far as the level of the vacuum valve 5.2. The vacuum valve 5.2 is kept closed by the prevailing negative pressure. When the liquid reaches a predetermined level in the receiving tank 1.6, i.e., the level at which the pressure being exerted via the liquid inlet 1.13 on the vacuum valve 5.2 is greater than the negative pressure keeping the vacuum valve 5.2 closed, the vacuum valve 5.2 opens automatically, so that the sludge-containing liquid can flow out continuously through the discharge opening 1.3.

A discharge element 5 such as a hose can be connected to the discharge opening 1.3 by means of a standard commercial quick-connect device; the free end 5.1 of this hose can be placed anywhere desired such as at a place where the sludge is to be dumped.

In addition to radio-control operation switch 3.2, a switch arrangement is also provided directly on the sludge extractor 1 in order to turn the sludge extractor on and off.

In other exemplary embodiments, two separate motors can be provided, so that a suction device near the bottom and another suction device relatively far away from the bottom can each be operated by its own motor.

The cover 1.4, the motor 1.7, the drive shaft 1.10, and the suction device 1.8 can be assembled as a unit and mounted so that they can be removed all at once. The prefilter 1.16 can also be removed as a unit. The unit and the prefilter can thus be easily detached from the receiving tank 1.6 for the purpose of cleaning.

The invention claimed is:

1. A sludge extractor, comprising:

a receiving tank having a suction connection connected to a suction element which draws in sludge-containing liquid and a discharge connection connected to a discharge element which discharges the sludge-containing liquid from the receiving tank;

a motor connected to a suction device, wherein said motor is operable for driving said suction device such that a negative pressure is created in said receiving tank;

a vacuum valve arranged in the discharge element, wherein the negative pressure acts on said vacuum valve and holds said vacuum valve closed until the sludge-containing liquid reaches a predetermined level at which level the pressure of the sludge-containing liquid acting on said vacuum valve surpasses the negative pressure acting on said vacuum valve and said valve opens, said vacuum valve being configured to open while said motor continues to operate said suction device to draw in the sludge containing liquid; and a safety valve installed in said receiving tank proximate a maximum fill level of said receiving tank.

2. The sludge extractor of claim 1, wherein said motor includes a drive shaft having a free end which extends to a position proximate a bottom of the interior of said receiving tank, said suction device being mounted on said free end.

3. The sludge extractor of claim 2, wherein said drive shaft is mounted in a center of said receiving tank.

4. The sludge extractor of claim 3, further comprising a prefilter mounted in said receiving tank receiving the sludge-containing liquid drawn in through said suction connection, wherein said prefilter is mounted concentrically with respect to said drive shaft.

5. The sludge extractor of claim 3, wherein said safety valve is ring-shaped and is mounted concentrically with respect to said drive shaft.

6. The sludge extractor of claim 4, wherein said safety valve is ring-shaped and is mounted concentrically with respect to said drive shaft.

7. The sludge extractor of claim 1, further comprising a flow channel arranged in said receiving tank and extending between said suction device and said discharge connection, said suction device being located within said flow channel, said flow channel having a first liquid inlet arranged at an intake side of said suction device for the liquid to be drawn into said flow channel and a second liquid inlet for the liquid arranged on a discharge side of said suction device.

8. The sludge extractor of claim 1, further comprising a prefilter mounted in said receiving tank receiving the sludge-containing liquid drawn in through said suction connection.

9. The sludge extractor of claim 1, wherein said safety valve is a float valve.

* * * * *